US010533460B2

(12) United States Patent
Jourdain et al.

(10) Patent No.: US 10,533,460 B2
(45) Date of Patent: Jan. 14, 2020

(54) MULTI STAGE STEAM TURBINE FOR POWER GENERATION

(71) Applicant: General Electric Technology GmbH, Baden (CH)

(72) Inventors: Vincent Jourdain, Paris (FR); Martin Toulemonde, Paris (FR)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 308 days.

(21) Appl. No.: 14/967,955

(22) Filed: Dec. 14, 2015

(65) Prior Publication Data

US 2016/0194982 A1 Jul. 7, 2016

(30) Foreign Application Priority Data

Jan. 5, 2014 (EP) ..... 15290001

(51) Int. Cl.
*F01K 17/00* (2006.01)
*F01K 13/02* (2006.01)
*F01D 25/32* (2006.01)

(52) U.S. Cl.
CPC ..... *F01K 13/02* (2013.01); *F01D 25/32* (2013.01)

(58) Field of Classification Search
CPC . F01D 25/32; F01K 13/02; F01K 7/04; F01K 7/165; F01K 17/00
USPC ..... 60/648
See application file for complete search history.

(56) References Cited

U.S. PATENT DOCUMENTS 4,274,256 A * 6/1981 Kalt ..... F01K 7/34 60/39.182
4,455,836 A 6/1984 Binstock et al.
5,433,079 A * 7/1995 Badami ..... F01D 19/02 60/646
2009/0199656 A1* 8/2009 Kumar ..... F16L 55/02718 73/861.61
2013/0032100 A1* 2/2013 Wepfer ..... F22B 1/025 122/4 R
2013/0330175 A1* 12/2013 Patel ..... F01D 11/06 415/144
2014/0366537 A1 12/2014 Hellweg et al.

FOREIGN PATENT DOCUMENTS

FR 2426158 A1 12/1979
JP 2013151876 A 8/2013
RU 2209320 C2 7/2003
RU 2010146183 A 5/2012
SU 1076606 A1 2/1984

* cited by examiner

*Primary Examiner* — Jason D Shanske
(74) *Attorney, Agent, or Firm* — Grogan, Tuccillo & Vanderleeden, LLP

(57) ABSTRACT

The invention relates to a steam turbine having a plurality of stages comprising a plurality of points of admission connected to a plurality of admission lines, a feed line connected to the plurality of admission lines and at least one extraction line, extending from an intermediate stage of the steam turbine, for extracting steam from the steam turbine. The at least one capacity line fluidly connects an admission lines and at least one extraction line so as to bypass the steam turbine, and is further configured to increase a swallowing capacity of the steam turbine as measured from the feed line upstream of the capacity line compared to the plurality of points of admission.

9 Claims, 1 Drawing Sheet

MULTI STAGE STEAM TURBINE FOR POWER GENERATION

CROSS-REFERENCE TO RELATED APPLICATIONS

This application claims priority to EP Application No. 15290001.5 filed Jan. 5, 2015, the contents of which are hereby incorporated in its entirety.

TECHNICAL FIELD

The present disclosure relates generally to multi-stage steam turbines used for power generation and more specifically to steam turbine configurations that vary the swallowing capacity of the steam turbine.

BACKGROUND

A steam power plant typically comprises a steam generator and a pressure series of steam turbines wherein the steam conditions of the first steam turbine inlet is dependent upon the actual condition of the steam generators. While steam generator and steam turbine performance can be initially matched to provide optimum performance, overtime the performance of the steam generator typically deteriorates resulting in lower steam pressure at the steam turbine for a given thermal load. It is further possible that the plant may be operated at a higher thermal load than initially designed. Both these circumstances may lead to a need for increased swallowing capacity. A way to solve this problem is to initially define a high swallowing capacity of the steam turbine. However, if the steam turbine is initially designed to have a high swallowing capacity, during initial, operation significant throttling of the turbine control valves could be required resulting in a loss of plant efficiency. There is therefore a need to seek an alternative.

SUMMARY

A steam turbine is disclosed that is intended to provide a simple means to increase the swallowing capacity of the steam turbine.

It attempts to address this problem by means of the subject matter of the independent claim. Advantageous embodiments are given in the dependent claims.

One general aspect includes a steam turbine having, a plurality of stages, an inlet, a feed line connected to an plurality of points of admission by a plurality of admission lines and configured to direct steam into the steam turbine, at least one extraction line extending from an intermediate stage of the steam turbine and configured to extracting steam from the steam turbine, as well as a capacity line. The capacity line fluidly connects at least one admission line to the at least one extraction line so as to bypass the steam turbine and is further configured to increase the swallowing capacity of the steam turbine as measured from the feed line compared to at the inlet.

Further aspects may include one or more of the following features. The capacity line having an internal resistance to flow such that in use the capacity line increases the swallowing capacity in a range of 1 vol % to 5 vol %. The capacity line including an orifice plate. The capacity line including an orifice box. A control/stop valve in each of the plurality of admission lines wherein the capacity line is connected to at least one admission line at a connection point fluidly between the control/stop valve and a point of admission. The connection point configured as a low point of the at least one admission line so as enable the draining of condensate from the plurality of admission lines through the capacity line.

Another general aspect includes a method for increasing a swallowing capacity of a steam turbine by at least 1 vol %. The method comprises providing a plurality of admission lines for feeding steam into the steam turbine and an extraction line for extracting steam from an intermediate stage of the steam turbine and then fluidly connecting at least one admission line to the extraction line by means of a capacity line so as to bypass the steam turbine. A capacity line having a stop valve and a drain bypass line connected upstream and downstream of the stop valve so as to enable to continuously draining of the capacity line when the stop valve is in a closed position.

Further aspects of the method may include one or more of the following aspects. Sizing the capacity line, in addition to increasing swallowing capacity, to also drain the related admission lines. Providing a stop valve in the capacity line and a drain bypass line connected upstream and downstream of the stop valve so as to enable a flow of condensate through the capacity line when the stop valve is in a closed position. Opening the stop valve when a load of the steam turbine exceeds 95%, preferably between 95% and 100% of the nominal load.

It is a further object of the invention to overcome or at least ameliorate the disadvantages and shortcomings of the prior art for base load units while providing significant performance improvements.

Other aspects and advantages of the present disclosure will become apparent from the following description, taken in connection with the accompanying drawings which by way of example illustrate exemplary embodiments of the present invention.

BRIEF DESCRIPTION OF THE DRAWINGS

By way of example, an embodiment of the present disclosure is described more fully hereinafter with reference to the accompanying drawing, in which.

DETAILED DESCRIPTION

Figure 1:
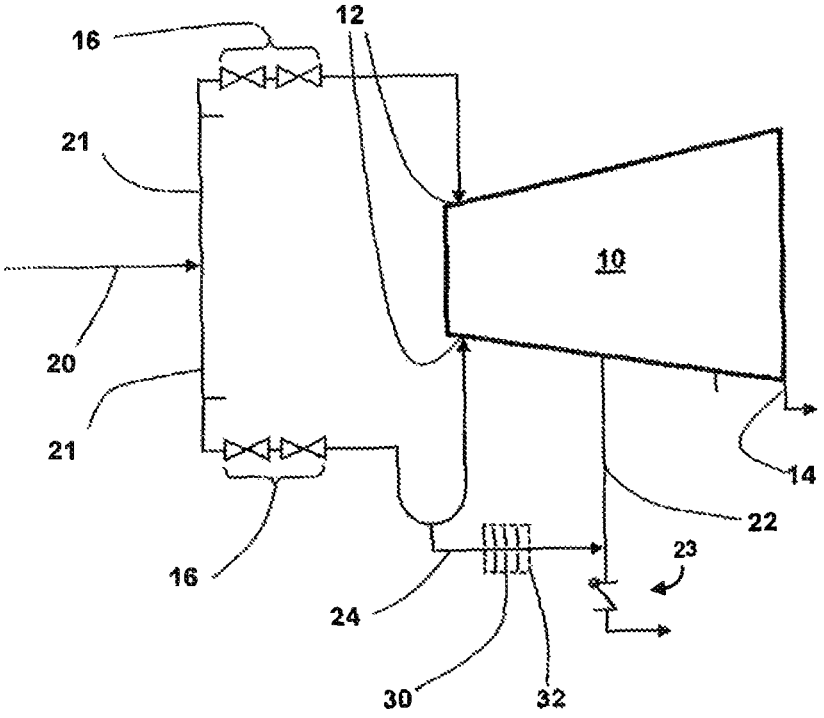
FIG. 1 is a schematic of a steam turbine according to an exemplary embodiment of the disclosure having a capacity line.

Exemplary embodiments of the present disclosure are now described with references to the drawings, wherein like reference numerals are used to refer to like elements throughout. In the following description, for purposes of explanation, numerous specific details are set forth to provide a thorough understanding of the disclosure. However, the present disclosure may be practiced without these specific details, and is not limited to the exemplary embodiment disclosed herein.

Throughout this specification reference is made to the term "swallowing capacity". In this context swallowing capacity is defined as a flow passing ability of a steam turbine in terms of its capacity to accept a volumetric steam flow.

An exemplary embodiment shown in FIG. 1 comprises a multi-stage steam turbine 10 with a feed line 20, an extraction line 22 and a capacity line 24.

The feed line 20 may include multiple points of admission into the steam turbine 10 by having one or more admissions lines 21 connected to the steam turbine 10 at points of admission 12 located at an upstream end of the steam turbine 10. As is known in the art, the feed line 20 may further include control/stop valves 16 located in the admission lines 21 upstream of the points of admission 12 as well as drain lines for the drainage of condensate.

The extraction line 22 is connected to an intermediate stage of the steam turbine 10, which is a point between the points of admission 12 of the steam turbine and an outlet 14 where steam is primarily exhausted from the steam turbine 10 and further directed to a cold steam re-heater or a lower pressure steam turbine. The extraction line 22 may exhaust to any known receiving body including a feedwater pre-heater 23 (FIG. 1) or a moisture separator re-heater.

The capacity line 24 fluidly connects the feed line 20 to the extraction line 22 so as to bypass the steam turbine 10. In an exemplary embodiment, the capacity line 24 is configured to take into account the maximum expected flow-rate through the capacity line 24 over the life of the steam turbine 10, which in an exemplary embodiment enables at least between 1 vol % and 5 vol % increase in steam turbine 10 swallowing capacity, as measured by a total flow through the feed line 20, which is a combination of flow through the capacity line 24 and the flow through the points of admission 12. This is achieved through the configuration of the flow resistance of the capacity line 24 wherein the flow resistance is defined by features such as internal diameter, inner surface roughness, internal flow restrictions, and pipe run including elbows.

In an exemplary embodiment, the capacity line 24 is configured through sizing of the capacity line 24 to serve the dual purpose of a drain line to drain condensate from the admission line 21 and further to increase the steam turbine 10 swallowing capacity. In this configuration, the capacity line 24 may replace an existing drain line.

To limit and control the flow-rate through the capacity line 24, an exemplary embodiment includes an orifice plate 30 whose size may be pre-calculated based on expected steam conditions. In a further exemplary embodiment, the capacity line 24 includes an orifice box 32 with one or more orifice plates 30 that can provide the equivalent flow restriction of a single orifice plate 30. With normal steam conditions, the orifice plate 30 is designed to accommodate normal drain flow. When the plant condition reaches a level where the required swallowing capacity is above turbine actual swallowing capacity, the orifice plate 30 is replaced by a larger orifice plate 30 designed to accommodate the required steam flow in addition to the normal drain flow. If the expected normal conditions do not materialize, or if normal conditions vary beyond anticipated limits, the same operation of change-over can also be performed with an appropriate sized orifice plate 30.

An advantage provided by the capacity line 24 is its simplicity, requiring minimum cost and low maintenance effort. It further may eliminate the need for a control stage or overload valves and does not need operator effort to function or costly controls. In addition, fluid flow through the capacity line 24 may reduce the turbine extraction flow requirement and thus may enable the steam turbine 10 to generate additional power to recover some of the steam turbine's 10 output capacity despite the lower steam conditions.

An exemplary method for increasing the swallowing capacity of a steam turbine 10 by at least 1 vol % includes providing a feed line 20 for feeding steam into the steam turbine 10 and an extraction line 22 for extracting steam from an intermediate stage of the steam turbine 10 and then fluidly connecting the feed line 20 to the extraction line 22 by means of a capacity line so as to bypass the steam turbine 10.

Figure 2:
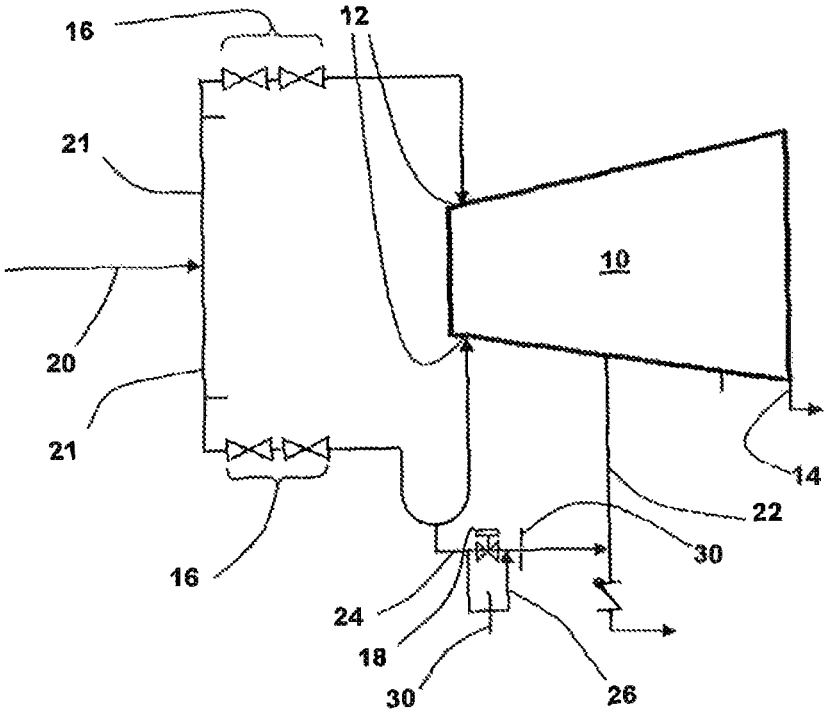
FIG. 2 is a schematic of a steam turbine according to another exemplary embodiment in which the capacity line includes a stop valve and a drain bypass line.

An exemplary embodiment shown in FIG. 2 further includes a stop valve 18 in the capacity line 24 and a drain bypass line 26 that is connected to points upstream and downstream of the stop valve 18. These connection points of the bypass line 26 enable a flow of condensate through the capacity line 24 even when the stop valve 18 is in a closed position. This arrangement may be advantageous for units which are only partial base load units. For example, during partial load operation of such units, the partial load of the steam turbine 10 with the stop valve 18 in open position could result in a lowering of the efficiency of the turbine cycle. This issue can be solved by closing the stop valve 18 and then re-opening the stop valve 18 when the turbine load is between 95% and 100% of nominal load. In this way the swallowing capacity of the steam turbine 10 can be easily and simply adjusted to match the steam turbine 10 load.

This exemplary method has the further advantage of being a possible simple and cost effective retrofit solution that does not require adaptation of the turbine, its control system or changes to operating actions.

Although the disclosure has been herein shown and described in what is conceived to be the most practical exemplary embodiment, it will be appreciated that the present disclosure can be embodied in other specific forms. The presently disclosed embodiments are therefore considered in all respects to be illustrative and not restricted. The scope of the disclosure is indicated by the appended claims rather that the foregoing description and all changes that come within the meaning and range and equivalences thereof are intended to be embraced therein.

What is claimed is:

1. A steam turbine having a plurality of stages, comprising:

a plurality of points of admission in fluid communication with a plurality of admission lines;

a feed line in fluid communication with the plurality of admission lines;

at least one extraction line, extending from an intermediate stage of the steam turbine, for extracting steam from the steam turbine; and at least one capacity line which comprises an orifice plate and is in fluid communication with at least one of the plurality of admission lines and the at least one extraction line so as to bypass the steam turbine, and is configured to increase a swallowing capacity of the steam turbine as measured from the feed line upstream of the capacity line compared to the plurality of points of admission, and wherein the at least one capacity line has an internal resistance to flow such that in use the at least one capacity line increases the swallowing capacity in a range of 1 vol % to 5 vol %.

2. The steam turbine of claim 1, wherein each of the admission lines comprises a control/stop valve, and the at least one capacity line is in fluid communication with at least one of the plurality of admission lines at a connection point between the control/stop valve and at least one of the plurality of points of admission.

3. The steam turbine of claim 2, wherein the connection point is configured to drain condensate from the at least one of the plurality of admission lines through the at least one capacity line.

4. The steam turbine of claim 1, wherein the at least one capacity line further comprises an orifice box, and the orifice plate forms part of a series of orifice plates disposed in the orifice box.

5. The steam turbine of claim 1, wherein the at least one capacity line further comprises:

a stop valve; and a drain bypass line connected upstream and downstream of the stop valve so as to enable a flow of condensate through the at least one capacity line when the stop valve is in a closed position.

6. A method for increasing a swallowing capacity of a steam turbine by at least 1 vol %, the method comprising:

providing a plurality of admission lines for feeding steam into the steam turbine at points of admission and an extraction line for extracting steam from an intermediate stage of the steam turbine; and fluidly connecting at least one admission line to the extraction line by means of a capacity line so as to bypass the steam turbine, and wherein the capacity line has an internal resistance to flow such that in use the capacity line increases the swallowing capacity in a range of 1 vol % to 5 vol %.

7. The method of claim 6, wherein the step of fluidly connecting at least one admission line to the extraction line includes:

sizing the capacity line, in addition to increasing swallowing capacity, to also remove a condensate from at least one of the plurality of admission lines.

8. The method of claim 6 further comprising:

providing a stop valve in the capacity line;

providing a drain bypass line connected upstream and downstream of the stop valve so as to enable a flow of condensate through the capacity line when the stop valve is in a closed position; and opening the stop valve when a load of the steam turbine is between 95% and 100% of the nominal load.

9. A steam turbine comprising:

a plurality of points of admission in fluid communication with a plurality of admission lines;

a feed line in fluid communication with the plurality of admission lines;

at least one extraction line, extending from an intermediate stage of the steam turbine, for extracting steam from the steam turbine and exhausting the steam to a feedwater preheater; and at least one capacity line in fluid communication with at least one of the plurality of admission lines and the at least one extraction line so as to bypass the steam turbine to facilitate an increase in a swallowing capacity of the steam turbine, and wherein the at least one capacity line has an internal resistance to flow such that the at least one capacity line increases the swallowing capacity in a range of 1 vol % to 5 vol %.

* * * * *